US011891761B2

(12) United States Patent
Wollanek et al.

(10) Patent No.: US 11,891,761 B2
(45) Date of Patent: Feb. 6, 2024

(54) MACHINE FOR STABILIZING A TRACK

(71) Applicant: Plasser & Theurer Export von Bahnbaumaschinen GmbH, Vienna (AT)

(72) Inventors: Samuel Wollanek, Pregarten (AT); Nikolaus Matzinger, Oberneukirchen (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 839 days.

(21) Appl. No.: 16/960,131

(22) PCT Filed: Jan. 14, 2019

(86) PCT No.: PCT/EP2019/050767
§ 371 (c)(1),
(2) Date: Jul. 6, 2020

(87) PCT Pub. No.: WO2019/158288
PCT Pub. Date: Aug. 22, 2019

(65) Prior Publication Data

US 2021/0071369 A1 Mar. 11, 2021

(30) Foreign Application Priority Data

Feb. 13, 2018 (AT) ..... A 36/2018

(51) Int. Cl.
*E01B 27/20* (2006.01)

(52) U.S. Cl.
CPC ..... *E01B 27/20* (2013.01); *E01B 2203/127* (2013.01)

(58) Field of Classification Search
CPC ..... E01B 27/16; E01B 27/17; E01B 27/20; E01B 2203/10; E01B 2203/12;
(Continued)

(56) References Cited

U.S. PATENT DOCUMENTS 4,111,129 A * 9/1978 von Beckmann ..... E01B 27/16 104/10
6,717,379 B1 * 4/2004 Andersson ..... E01C 19/38 404/117

(Continued)

FOREIGN PATENT DOCUMENTS

AT 517999 A1 * 6/2017 ..... E01B 27/20
AT 518373 A1 9/2017

(Continued)

OTHER PUBLICATIONS

International Search Report of PCT/EP2019/050767 in Chinese, dated Mar. 21, 2019, with English translation.

(Continued)

*Primary Examiner* — Zachary L Kuhfuss
*Assistant Examiner* — Cheng Lin
(74) *Attorney, Agent, or Firm* — Collard & Roe, P.C.

(57) ABSTRACT

The invention relates to a machine for stabilizing a track, including a machine frame supported on on-track undercarriages and a vertically adjustable stabilizing unit designed to roll on rails of the track by means of unit rollers, the stabilizing unit comprising a vibration exciter with rotating imbalance masses for generating an impact force ($F_S$) acting dynamically in a track plane perpendicularly to a track longitudinal direction and a vertical drive for generating a vertical load acting on the track. In this, it is provided that the vibration exciter comprises at least two imbalance masses which are driven applying a variably adjustable phase shift ($\Delta\varphi_1$, $\Delta\varphi_2$). The invention further relates to a method for operating such a machine.

10 Claims, 10 Drawing Sheets

(58) Field of Classification Search
CPC ..... E01B 2203/122; E01B 2203/127; B06B 1/18; B06B 1/16; B06B 1/161
See application file for complete search history.

(56) References Cited

U.S. PATENT DOCUMENTS

| | | | | |
|---|---|---|---|---|
| 10,914,041 | B2 | 2/2021 | Auer et al. | |
| 2013/0269563 | A1 | 10/2013 | Wildroither | |
| 2018/0297081 | A1 * | 10/2018 | Philipp | E01B 27/17 |

FOREIGN PATENT DOCUMENTS

| | | | | | |
|---|---|---|---|---|---|
| CN | 104562873 | A | * | 4/2015 | E01B 27/20 |
| CN | 106592349 | A | * | 4/2017 | E01B 27/20 |
| CN | 106592349 | A | | 4/2017 | |
| CN | 206486753 | U | | 9/2017 | |
| CN | 107227661 | A | | 10/2017 | |
| DE | 102011008835 | A1 | | 7/2012 | |
| FR | 1 347 335 | A | | 12/1963 | |
| FR | 2671744 | A1 | * | 7/1992 | B06B 1/16 |
| SU | 96295 | A1 | | 11/1952 | |
| WO | 2008/009314 | A1 | | 1/2008 | |
| WO | WO-2008009314 | A1 | * | 1/2008 | E01B 27/20 |

OTHER PUBLICATIONS

Chinese Office Action in Chinese Application No. 201980010900.5 dated Sep. 22, 2021.

* cited by examiner

MACHINE FOR STABILIZING A TRACK

CROSS REFERENCE TO RELATED APPLICATIONS

This application is the National Stage of PCT/EP2019/050767 filed on Jan. 14, 2019, which claims priority under 35 U.S.C. § 119 of Austrian Application No. A 36/2018, filed on Feb. 13, 2018, the disclosure of which is incorporated by reference. The international application under PCT article 21(2) was not published in English.

FIELD OF TECHNOLOGY

The invention relates to a machine for stabilizing a track, including a machine frame supported on on-track undercarriages and a vertically adjustable stabilizing unit designed to roll on rails of the track by means of unit rollers, the stabilizing unit comprising a vibration exciter with rotating imbalance masses for generating an impact force acting dynamically in a track plane perpendicularly to a track longitudinal direction and a vertical drive for generating a vertical load acting on the track. The invention further relates to a method for operating such a machine.

PRIOR ART

Machines for stabilizing a track are already well known from the prior art. In a so-called dynamic track stabilizer, stabilizing units located between two on-track undercarriages are lowered via a vertical adjustment onto a track to be stabilized and are actuated with a vertical load. During continuous forward travel, a transverse vibration of the stabilizing units is transmitted to the track via unit rollers and clamping rollers abutting outer sides of the rail heads.

A machine of this type is known, for example, from WO 2008/009314 A1. In this, the stabilizing unit comprises adjustable imbalance masses in order to quickly reduce the impact force, if required, to a reduced value or to zero (for example, at bridges or tunnels) and to raise it to the initial value immediately upon reaching a track section to be stabilized.

A disadvantage here is the intricate structure of the moving parts. In addition, a deliberate adjustment of the required impact force is complicated as far as control engineering.

SUMMARY OF THE INVENTION

It is the object of the invention to provide an improvement over the prior art for a machine of the kind mentioned at the beginning. A further object lies in disclosing a method for operating such a machine.

According to the invention, these objects are achieved by way of a machine according to claim 1 and a method. Dependent claims indicate advantageous embodiments of the invention.

The invention provides that the vibration exciter comprises at least two imbalance masses which are driven applying a variably adjustable phase shift. By way of the variably adjustable phase shift, the impact force acting on the track can be changed purposefully. Depending on the arrangement of the imbalance masses, an altered phase shift changes both the direction as well as the power of the impact force.

Advantageously, a left-turning imbalance mass and a right-turning imbalance mass form an imbalance mass pair, wherein at least one imbalance mass of said imbalance mass pair is driven applying a first phase shift which is variably adjustable with respect to an initial position. The imbalance masses move against one another, so that their centrifugal forces cancel each other out in one direction and thus an undesired directional component of the impact force is obliterated.

In an advantageous further development, an angle sensor is associated with each imbalance mass. By means of the respective angle sensor, the positions of the imbalance masses are always known precisely. Thus it is possible to set a prescribed phase shift by means of a control device. This is useful particularly in the case of mechanical drives such as, for example, hydraulic motors.

In addition, it is favourable if the respective imbalance mass is arranged on the stabilizing unit with a rotation axis being aligned in the track longitudinal direction. This alignment is suitable especially for use in a stabilizing unit, since the resulting impact force acts perpendicularly to the track longitudinal direction on the track to be stabilized. In this manner, energy is introduced into the track in an optimal way.

It is further advantageous if a separate drive is associated with each imbalance mass. A separate drive for each imbalance mass offers a structurally simple solution for being able to purposefully control each imbalance mass with a separate rotation angle position.

A simplified further development of the invention provides that a common drive is associated in each case with two imbalance masses. This solution is suited especially for compact stabilizing units, wherein the phase shift is set by means of a variable coupling, for example.

For the setting of the variable phase shift, it is particularly favourable if the respective drive is designed as an electric drive. Brushless electric motors or torque motors, for example, are suited especially well here for control in an angle control loop to achieve the desired phase shift.

In one embodiment of the invention, it is provided that the electric drives are controlled by means of a common control device. With this, the individual drives can be optimally coordinated with one another and controlled precisely. During a working operation, it is possible to access data previously stored in the control device in order to adapt the electric drives and a phase shift in an automatized way to local conditions and to an existing state of the track.

In another embodiment of the invention, it may be advantageous if the respective drive is designed as a hydraulic drive. Thus, the drives can be integrated into an already existing hydraulic system of the machine.

In an advantageous embodiment, an adjustment device for a variable phase shift is associated with the respective drive. The adjustment device is especially suited for mechanical drives to set an exact phase shift. With this, the respective imbalance mass is twisted at the required angle relative to the drive in a simple manner. The adjustment device can be used for setting the phase shift also when driving two imbalance masses with a common drive.

A further improvement provides that the vibration exciter comprises at least four rotatable imbalance masses, of which two imbalance masses in each case are driven right-turning and two imbalance masses are driven left-turning. By way of a purposeful arrangement of at least four imbalance masses, a precise and quick impact force adjustment up to a complete obliteration is possible.

In addition, it is useful if the two left-turning imbalance masses are driven with a variably adjustable second phase shift to one another, and if the two right-turning imbalance masses are driven with a variably adjustable second phase shift to one another. In this way, the impact force resulting from all impact masses can be adjusted relative to the track plane in an optimal manner in order to adapt the stabilization of the track precisely to local conditions.

The method, according to the invention, for operating a machine provides that the stabilizing unit is set down on the track via the vertical drive and actuated with a vertical load, and that at least two rotatable imbalance masses are driven applying a variably adjustable second phase shift to one another. Thus, a track stabilization with a variable impact force is guaranteed which is precisely adaptable to the local conditions.

In a favourable further development of the method, one imbalance mass in an imbalance pair is driven left-turning and one imbalance mass is driven right-turning, wherein at least one of these imbalance masses is driven applying a first phase shift which is variably adjustable with respect to an initial position. With the direction of the impact force changing during this, it is possible to boost the lowering of the track during the stabilization, if required.

In another further development of the method, in the case of four imbalance masses, two left-turning imbalance masses are driven applying a variably adjustable second phase shift to one another and two right-turning imbalance masses are driven applying a variably adjustable second phase shift to one another. This ensures a quick and exact impact force adjustment in the preferred effective direction.

BRIEF DESCRIPTION OF THE DRAWINGS

The invention will be described below by way of example with reference to the accompanying drawings. There is shown in.

DESCRIPTION OF THE EMBODIMENTS

Figure 1:
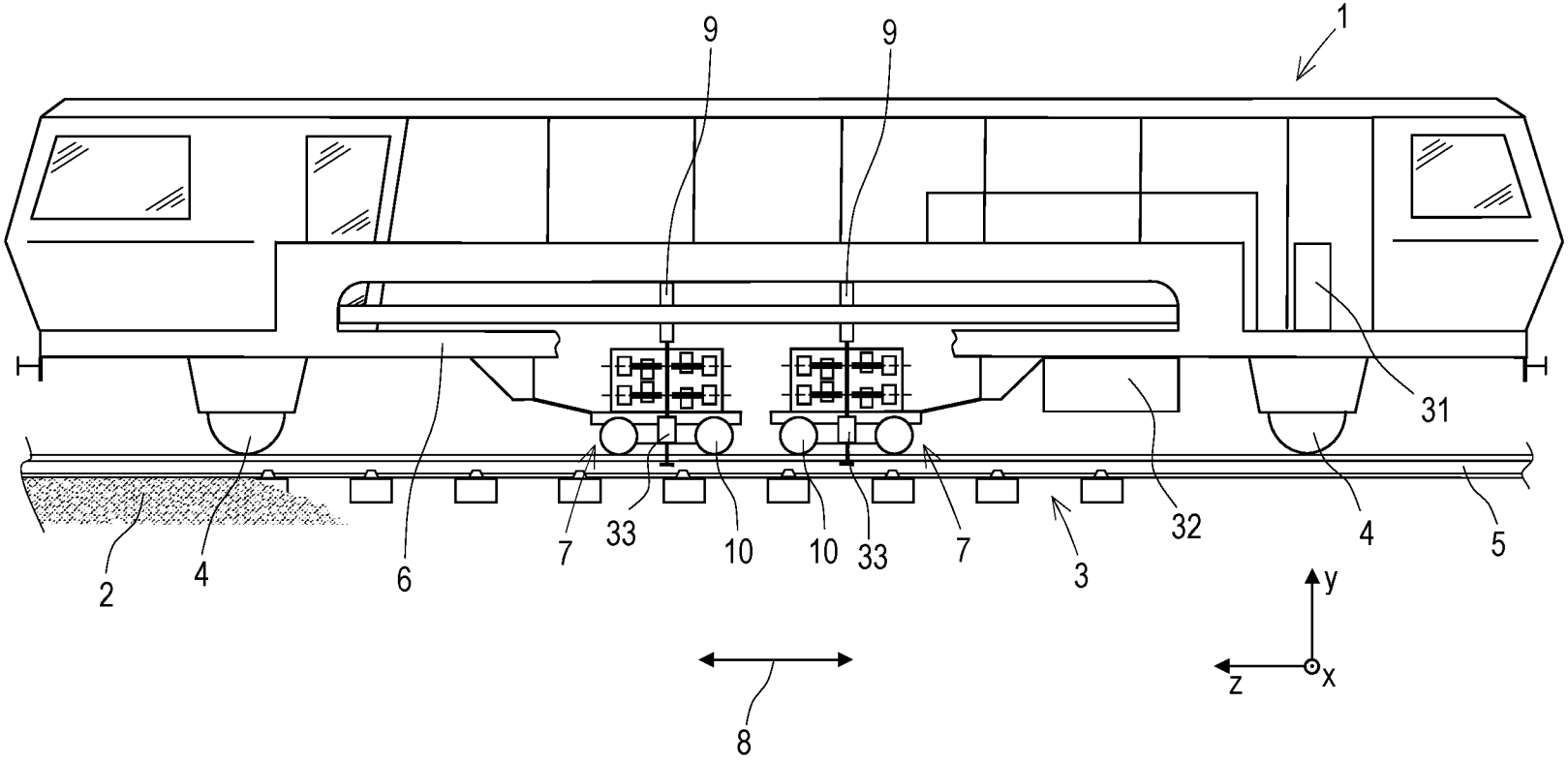
FIG. 1 a side view of a machine for stabilizing a track

FIG. 1 shows a machine 1 for stabilizing a track 3 resting on ballast 2, the machine having a machine frame 6 supported via on-track undercarriages 4 on rails 5. Arranged between the two on-track undercarriages 4 positioned at the ends are two stabilizing units 7, one following the other in the longitudinal direction 8 of the track. These are each connected for vertical adjustment to the machine frame 6 by vertical drives 9.

With the aid of unit rollers 10 designed to roll on the rails 5, each stabilizing unit 7 can be brought into form-fitting engagement with the track 3 in order to set the latter vibrating with a desired vibration frequency. The unit rollers 10 comprise two flanged rollers for each rail 5 which roll on the inside of the rail 5, and a clamp roller which, during operation, is pressed against the rail 5 from the outside by means of a clamp mechanism 33. A static vertical load is imparted to the track 3 by means of the vertical drives 9.

The stabilizing units 7 are controlled by means of a common control device 31. Drives 19 arranged in the stabilizing unit 7 are connected to a common supply device 32. In the case of electric drives 19, for example, this is a motor-generator unit with an electric memory. Also, a catenary can be used for supplying electric drives if the machine 1 has pantographs and appropriate inverters. In the case of hydraulic drives 19, the supply device 32 is naturally integrated into a hydraulic system of the machine 1.

Figure 2:
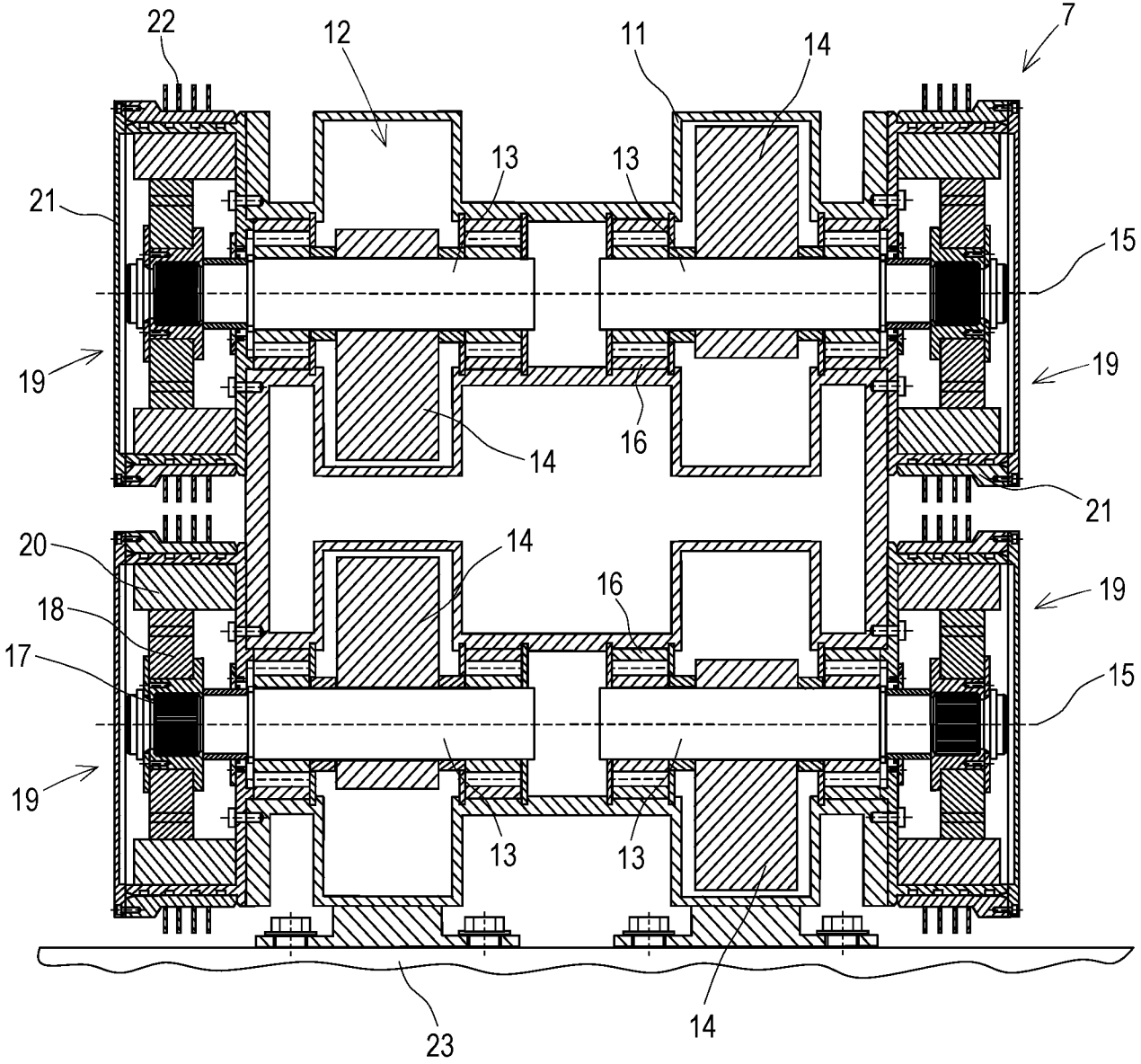
FIG. 2 a detail view of a stabilizing unit

In FIG. 2, one of the two stabilizing units 7 is shown in detail. Arranged inside an enclosure 11 is a vibration exciter 12 which comprises four rotation shafts 13 with imbalance masses 14 arranged thereon. Two rotation shafts 13 are arranged in each case on two axes of rotation 15. An imbalance mass 14 is arranged on each rotation shaft 13. Each rotation shaft 13 is mounted in the enclosure 11 at either side of the imbalance mass 14 via roller bearings 16.

Milled into an end, projecting from the enclosure 11, of the respective rotation shaft 13 is a toothing 17 on which a rotor 18 of a drive 19, designed as a torque motor, is connected form-fittingly to the associated rotation shaft 13. Arranged around the rotor 18 of the respective torque motor is a stator 20 which is connected by way of a motor housing 21 to the enclosure 11 of the vibration exciter 12. Cooling fins 22 are arranged on the outside of the motor housing 21. With this, heat arising during operation can be reliably dissipated.

At a lower end, the stabilizing unit 7 is connected to a stabilizing unit frame 23 in order to reliably transmit a vibration to the unit-/clamp rollers 10 and thus to the track 3. The imbalance masses 14 shown in FIG. 2 are driven independently of one another, with freely definable phase shifts between the individual imbalance masses 14. Use of four structurally identical drives 19, rotation shafts 13 and imbalance masses 14 allows an easier replaceability and supply of replacement parts in case of maintenance or damage. For use in a machine 1 having two stabilizing units 7, there is also an advantage resulting from the structurally identical designs of both stabilizing units 7. In addition, no transmission of force between the two stabilizing units 7 is necessary.

Figure 3:
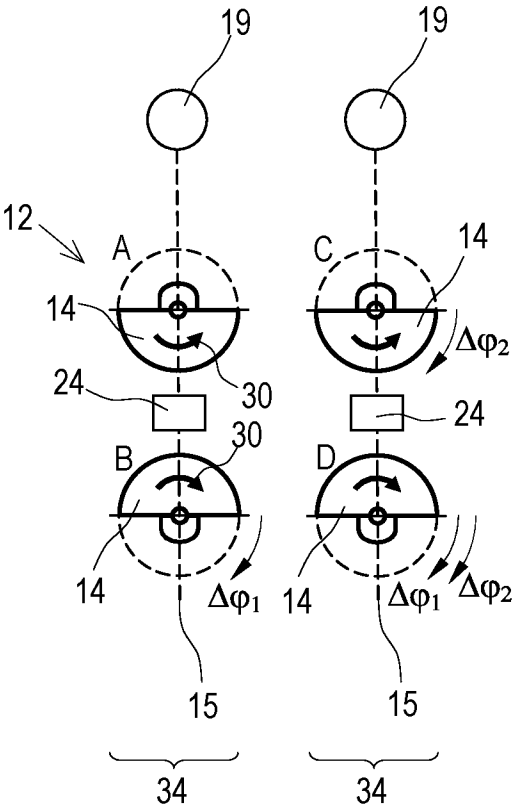
FIG. 3 a drive concept with two motors

FIG. 3 shows schematically a simplified variant of the vibration exciter 12.

Both imbalance masses 14 are driven with a prescribed rotation speed which defines the vibration frequency transmitted to the track 3. In exceptional cases, it may be useful to drive both imbalance masses 14 with different rotation speeds to cause a continuous change of impact force. Otherwise, all imbalance masses 14 rotate with the same rotation speed. In this, an impact force change is achieved solely by phase shifts $\Delta\varphi_1$, $\Delta\varphi_2$, in which one imbalance mass 14 runs ahead of the other one.

In order to be able to better explain the phase shifts $\Delta\varphi_1$, $\Delta\varphi_2$, the four imbalance masses 14 are shown next to each other and denoted by the characters A, B, C and D. Two imbalance masses A, B or C, D in each case form an imbalance mass pair 34 which is driven by means of a common drive 19. In this, the rotation directions 30 of the two imbalance masses A, B or C, D are opposite. In the example shown, the imbalance masses A and C are driven left-turning, and the imbalance masses B and D are driven right-turning. As shown in the embodiment according to FIG. 2, two imbalance masses A, C or B, D in each case can be arranged on a common rotation axis.

In order to achieve a change of rotation direction between the imbalance masses A, B or C, D of an imbalance mass pair 34, a reversing gear 24 is arranged in each case. In another variant, not shown, the two imbalance masses A, C or B, D rotating in the same direction are driven by means of a common drive 19. A reversing gear 24 is then not required. An adjustment device 25 (FIG. 5) is arranged for setting a phase shift between the imbalance masses 14 driven by means of a common drive 19. In this, a first phase shift $\Delta\varphi_1$ with respect to an initial position can be set at the imbalance masses 14 driven in opposite rotation directions. A second phase shift $\Delta\varphi_2$ can be set at the imbalance masses 14 rotating in the same direction.

Figure 4:
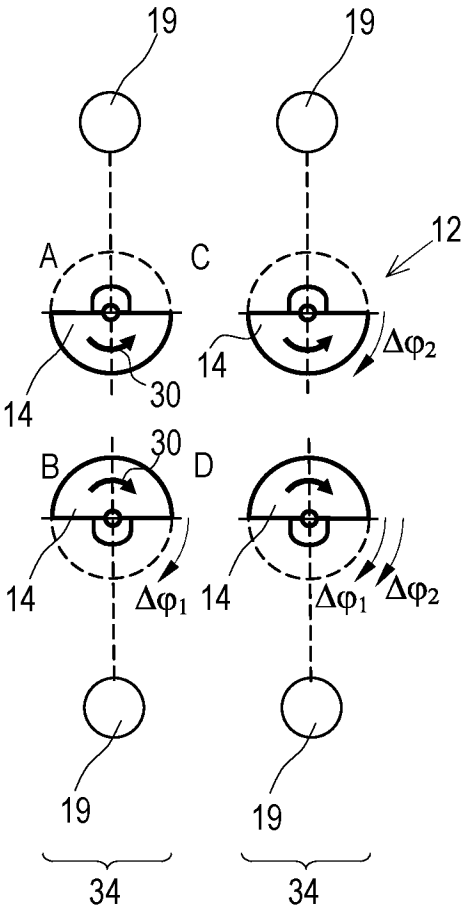
FIG. 4 a drive concept with four motors

In FIG. 4, taking reference to FIG. 2, the vibration exciter 12 is shown schematically, having a separate drive 19 per imbalance mass 14. As in the example according to FIG. 3, the imbalance masses A and C are driven left-turning and the imbalance masses B and D are driven right-turning. For setting the phase shifts $\Delta\varphi_1$, $\Delta\varphi_2$, each drive 19 can be controlled in a rotation-angle-dependent way, or an adjustment device 25 is arranged between each drive 19 and the associated imbalance mass 14.

Figure 5:
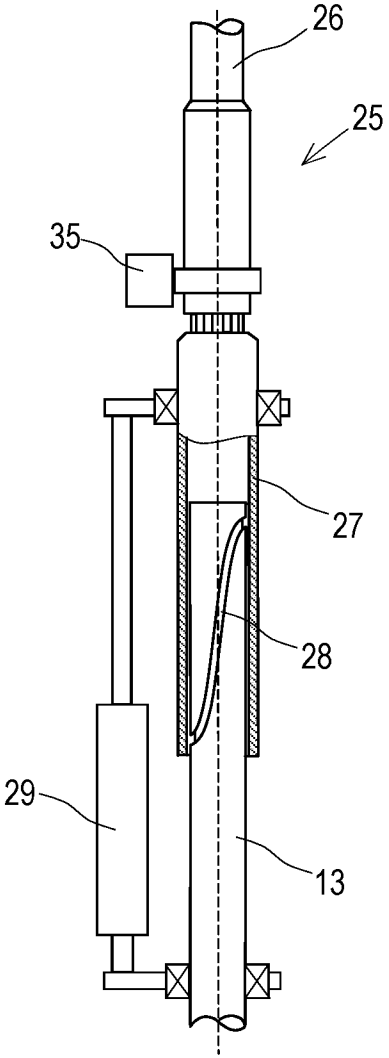
FIG. 5 an adjustment device for variable phase shift

FIG. 5 shows, for example, a mechanical adjustment device 25 for twisting the rotation shaft 13 of the imbalance mass 14 relative to a drive shaft 26 of the drive 19. To that end, the rotation shaft 13 is guided inside a sleeve 27 connected for longitudinal displacement to the drive shaft 26. Like a spindle, the rotation shaft 13 has at least one helical groove 28 with which an inside counterpiece of the sleeve 27 is in engagement.

The sleeve 27 and the rotation shaft 13 are rotatably mounted and connected to one another by means of a hydraulic cylinder 29. If a longitudinal displacement of the sleeve 27 relative to the rotation shaft 13 is caused by means of the hydraulic cylinder 29, the rotation shaft 13 including the imbalance mass 14 twists at the desired angle with respect to drive shaft 26. By twisting the rotation shaft 13 relative to the drive shaft 26, a phase shift $\Delta\varphi_1$, $\Delta\varphi_2$ with respect to another imbalance mass 14 is achieved.

The mechanical adjustment device 25 is suited especially in combination with synchronously driven hydraulic motors. Here, an angle sensor 35 is advantageously used to receive feedback about the angular position of the respective drive shaft 26 or rotation shaft 13. In a simplified solution as in FIG. 3, the arrangement of an adjustment device 25 between the imbalance masses 14 provided with a common drive 19 is also useful in order to achieve a phase shift $\Delta\varphi_1$, $\Delta\varphi_2$ between the two imbalance masses 14.

Figure 6:
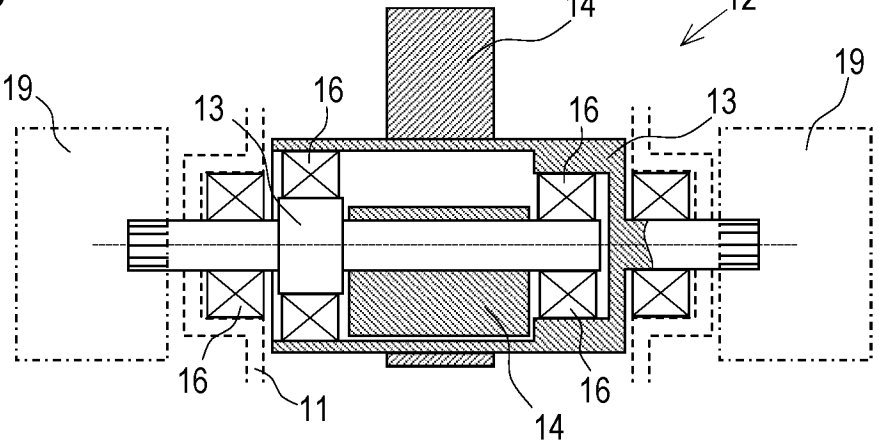
FIG. 6 a vibration exciter with hollow shaft

In the case of the vibration exciter 12 in FIG. 6, two imbalance masses 14 rotate about a common rotation axis 15. In this, one rotation shaft 13 is designed as a hollow shaft with an outer imbalance mass 14. Inside the hollow shaft, a free end of the other rotation shaft 13 is mounted with an inner imbalance mass 14. The rotation shafts 13 are mounted in an enclosure 11 via further roller bearings 16 and driven by means of separate drives 19. In this, the centrifugal forces of the rotating imbalance masses 14 act in a common plane, so that no tilting moments occur which would be possibly interfering. This mounting variant is particularly suited for a vibration exciter 12 having only two imbalance masses 14.

Figure 7:
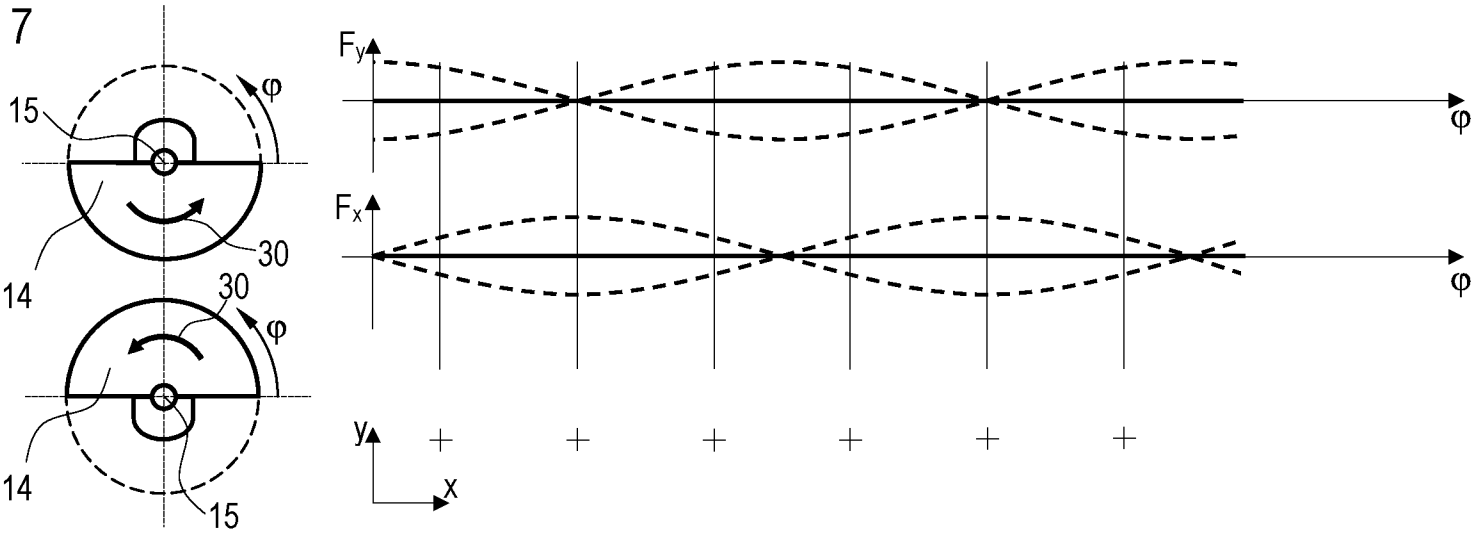
FIG. 7 imbalance masses rotating in the same direction with vibration obliteration FIG. 8 imbalance masses rotating in the same direction with reduced impact force FIG. 9 imbalance masses rotating in the same direction with maximal impact force FIG. 10 imbalance masses rotating in opposite direction with maximal impact force in one direction FIG. 11 imbalance masses rotating in opposite direction with reduced impact force FIG. 12 four imbalance masses with complete obliteration of the impact force FIG. 13 four imbalance masses with maximal impact force in x-direction FIG. 14 four imbalance masses with complete obliteration of the impact force FIG. 15 four imbalance masses with maximal impact force in y-direction FIG. 16 four imbalance masses with different settings of the phase shifts
Figure 8:
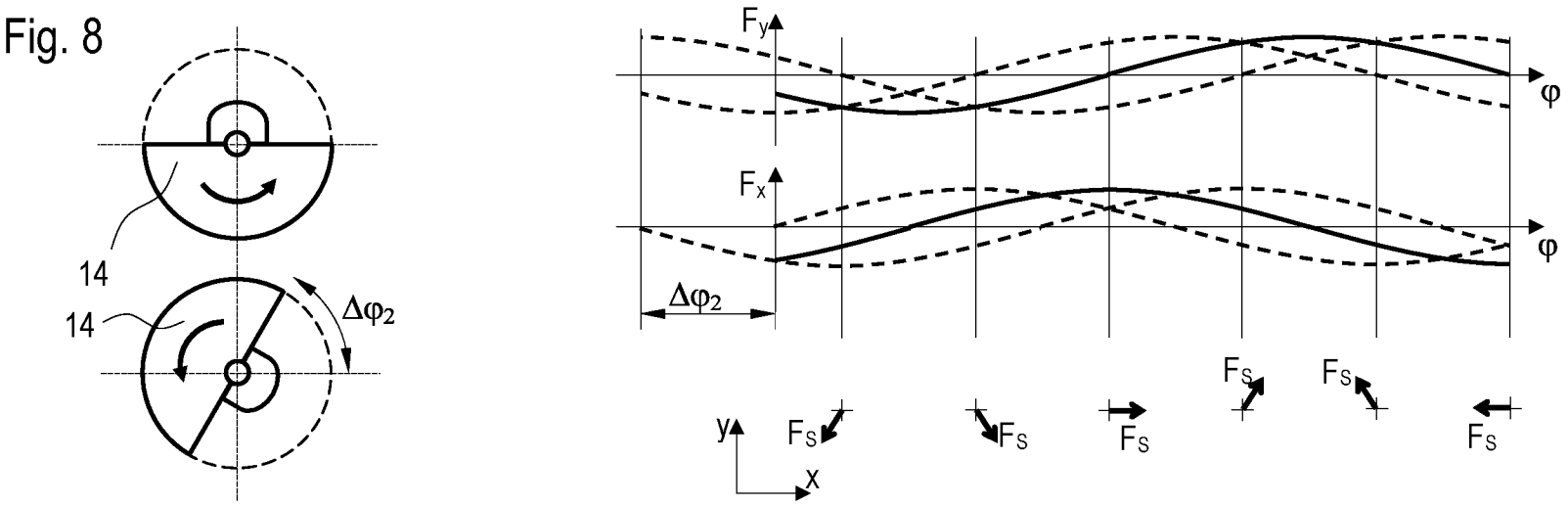
Figure 9:
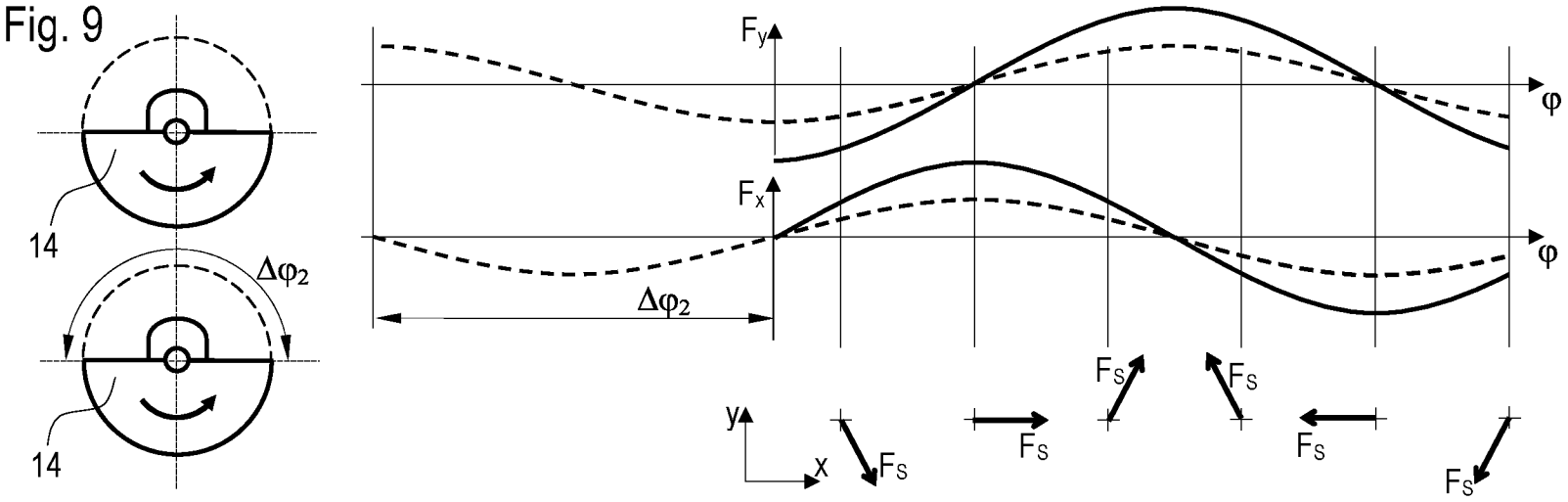

In FIGS. 7 to 9, the effect of a variable second phase shift 42 by means of two imbalance masses 14 rotating in the same direction is explained. At the left, the positions of the imbalance masses 14 to one another are shown. In this, the axes of rotation 15 are oriented in the track longitudinal direction 8 and thus extend parallel to a z-axis of a right-turning Cartesian coordinate system x, y, z drawn in FIG. 1. Diagrams show directional components $F_x$, $F_y$ of a resulting impact force $F_S$ over a common phase angle $\varphi$. Shown below that are impact force vectors for several phase angles $\varphi$ in the coordinate system x, y, z moved along with the machine 1. If, in an initial position according to FIG. 7, the second imbalance mass 14 is phase shifted by 180° relative to the first imbalance mass 14, the centrifugal forces are obliterated. The resulting directional components $F_y$, $F_x$ of the impact force $F_s$ equal zero.

In FIG. 8, a second phase shift $\Delta\varphi_2$ of 60° in the rotation direction with respect to the initial position is set for the second imbalance mass 14, so that the second imbalance mass 14 runs ahead of the first imbalance mass 14 by a total of 240°. From this, a rotating impact force $F_S$ with constant value results. The maximal impact force $F_s$ is attained if a second phase shift $\Delta\varphi_2$ of 180° in the rotation direction with respect to the initial position is set for the second imbalance mass 14. Then, both imbalance masses 14 rotate synchronously, so that the centrifugal forces add up (FIG. 9).

Figure 10:
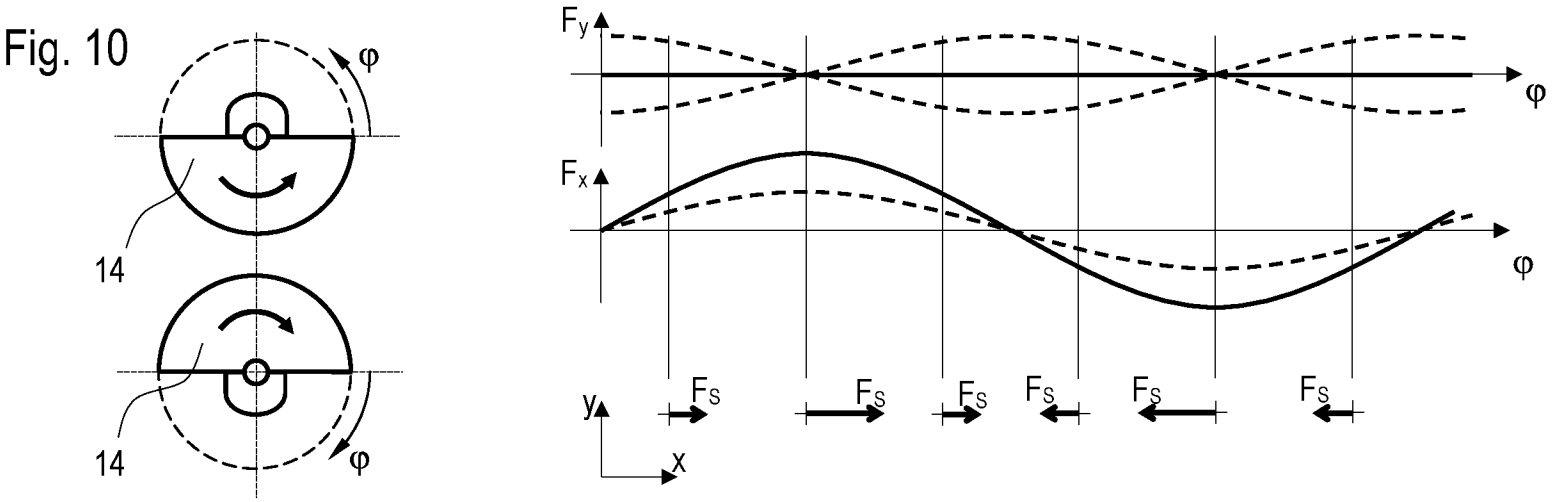
Figure 11:
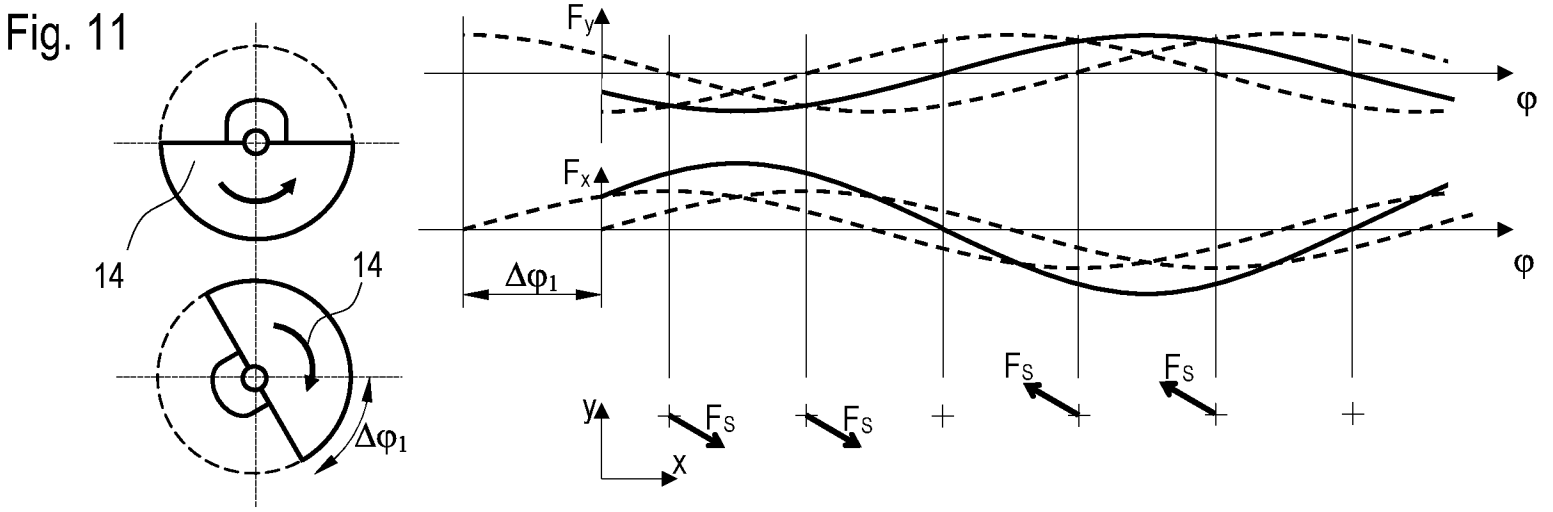

Corresponding images are shown in FIGS. 10 and 11 for two imbalance masses 14 rotating in opposite directions. In an initial position, the impact force component $F_y$ in y-direction is obliterated, and the greatest impact force ($F_S$) occurs in x-direction (FIG. 10). A change of the impact force $F_S$ takes place if a first phase shift $\Delta\varphi_1$ is set for an imbalance mass 14 with respect to the initial position. In FIG. 11, the first phase shift $\Delta\varphi_1$ of the second imbalance mass 14 is 60° in the rotation direction, for example. Then the impact force $F_S$ diminishes. In this, the effective direction of the impact force $F_S$ has an inclination angle with respect to the x-axis which corresponds to half of the first phase shift $\Delta\varphi_1$. Thus, a maximal impact force $F_S$ parallel to the y-axis results in the case of a first phase shift $\Delta\varphi_1$ of 180°.

In FIGS. 12 to 16, different phase shifts $\Delta\varphi_1$, $\Delta\varphi_2$ of four imbalance masses A, B, C and D according to FIGS. 3 and 4 are shown. Each of FIGS. 12 to 15 shows at the left side a first initial position of two imbalance mass pairs 34 with imbalance masses A, B or C, D rotating in opposite directions in each case (phase angle $\varphi$=0). Shown alongside (FIGS. 12, 13) or therebelow (FIGS. 14, 15) are progressions of the impact forces $F_{AB}$, $F_{CD}$ of the imbalance mass pairs 34 and of the overall resulting impact force $F_S$ over a common phase angle $\varphi$. Further, the positions of the imbalance masses 14 at a phase angle $\varphi$ of 90°, 180° and 270° are shown.

Figure 12:
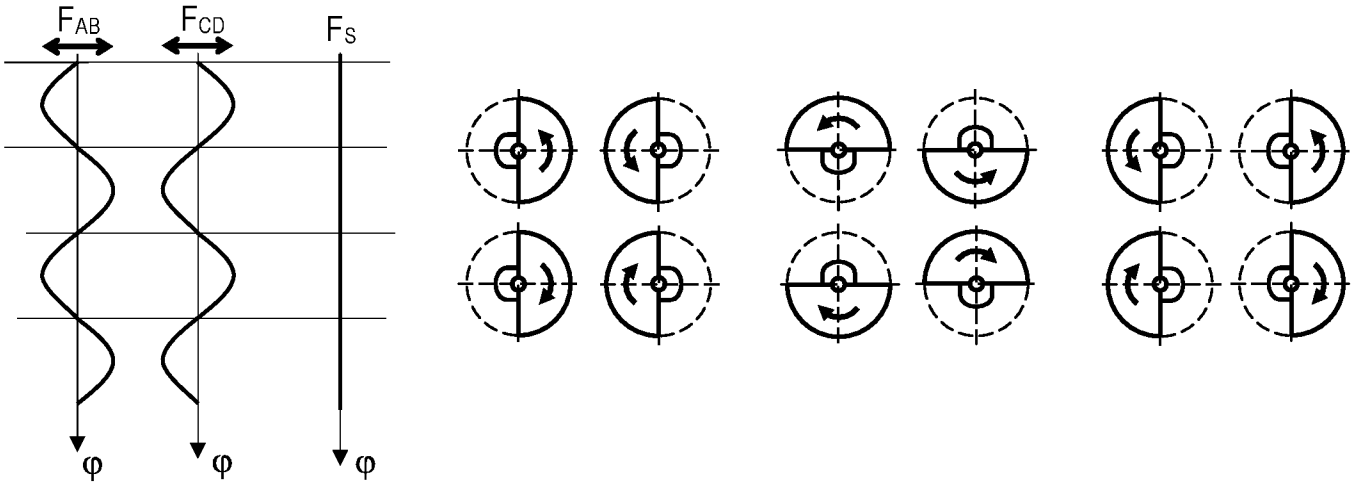
Figure 13:
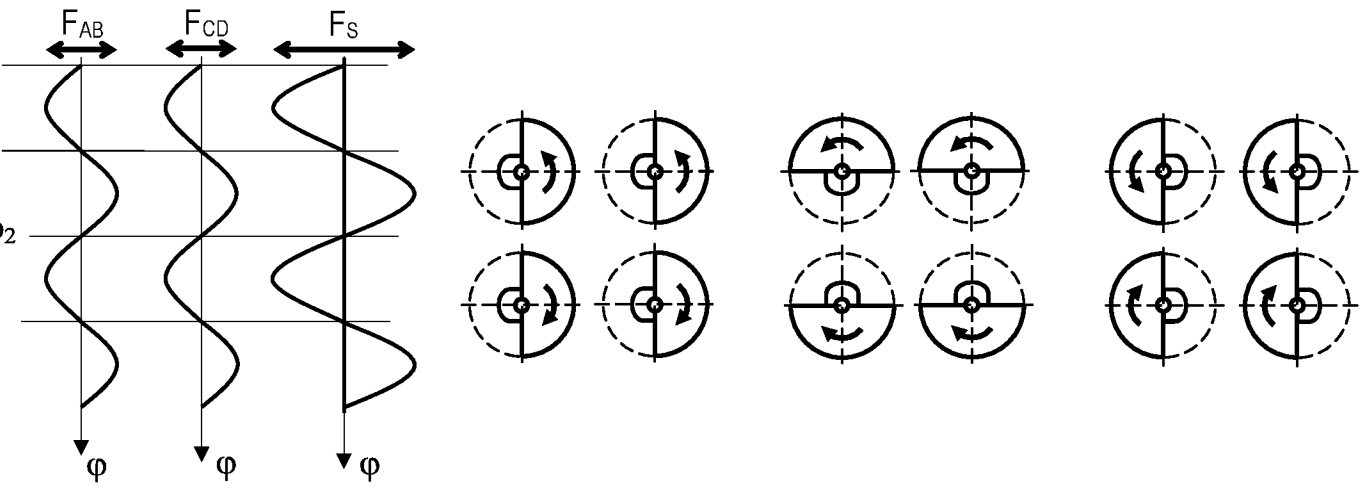

With the aid of FIGS. 12 and 13, an impact force adjustment in the direction of the x-axis, i.e. in the track plane perpendicularly to the track longitudinal direction 8, is explained. In this, the imbalance masses A, B or C, D of each imbalance mass pair 34 are phase shifted by 180° with regard to one another. As a result of the rotation directions 30 opposing one another, the centrifugal forces in the direction of the y-axis are obliterated, and the y-component of the impact force $F_S$ equals zero. In FIG. 12, the imbalance masses A, C or B, Direction, which are driven in the same rotation direction, are additionally phase shifted by 180° with respect to one another. Thus, an obliterated x-component also ensues for the overall resulting impact force $F_S$. Thus, in this initial position, no impact force $F_S$ acts on the track 3 despite rotating imbalance masses 14.

For a maximal impact force $F_S$ in the x-direction, the set second phase shift $\Delta\varphi_2$ is 180° (FIG. 7). Here, the imbalance masses A, C or B, D driven in the same rotation direction run synchronously, so that the centrifugal forces in x-direction add up. With the variably adjustable second phase shift $\Delta\varphi_2$ in the range of 0° to 180°, the resulting impact force $F_S$ in the direction of the x-axis can be precisely set from zero to the maximum.

Figure 14:
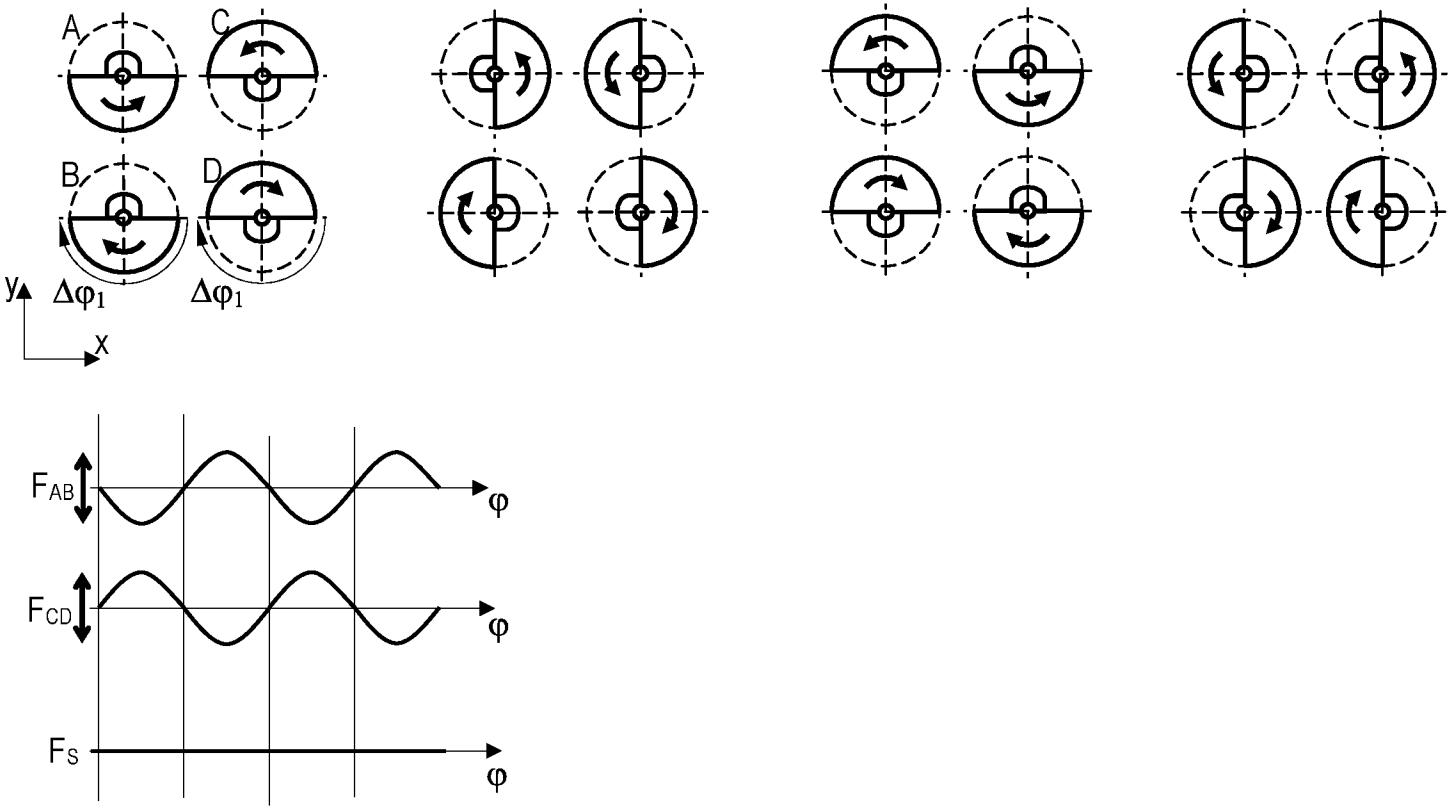
Figure 15:
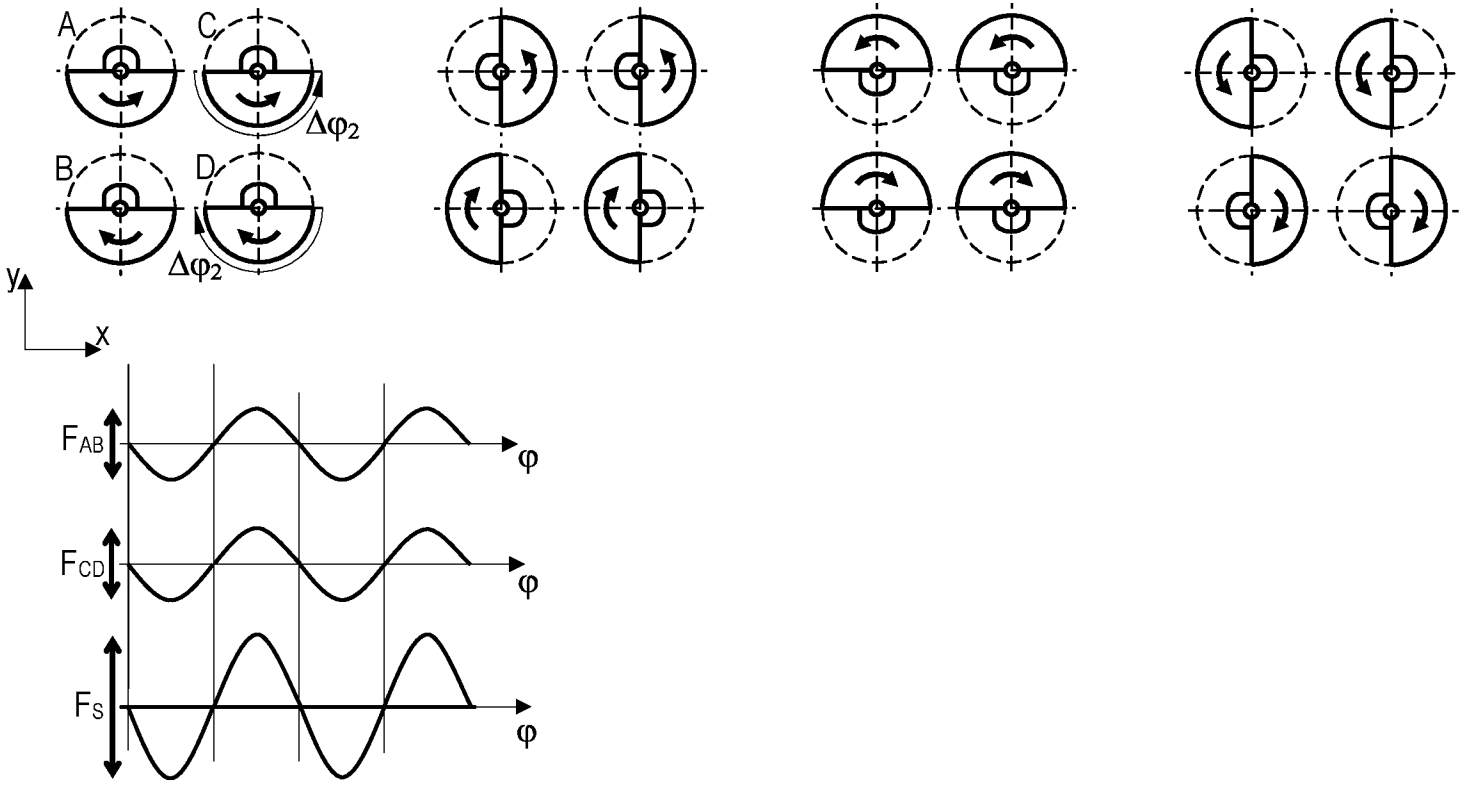

The adjustment of the impact force $F_S$ in the direction of the y-axis is explained with the aid of FIGS. 14 and 15. First, in each imbalance mass pair 34 an imbalance mass B or D is phase shifted with respect to the initial position in FIG. 12. In particular, at both imbalance mass pairs 34 a first phase shift $\Delta\varphi_1$ of 180° is set, so that a complete obliteration of the resulting impact force $F_S$ still exists (FIG. 14). In order to achieve a maximal impact force $F_S$ in the direction of the y-axis, a second phase shift of 180° is set relative to this new initial position (FIG. 15).

Figure 16:
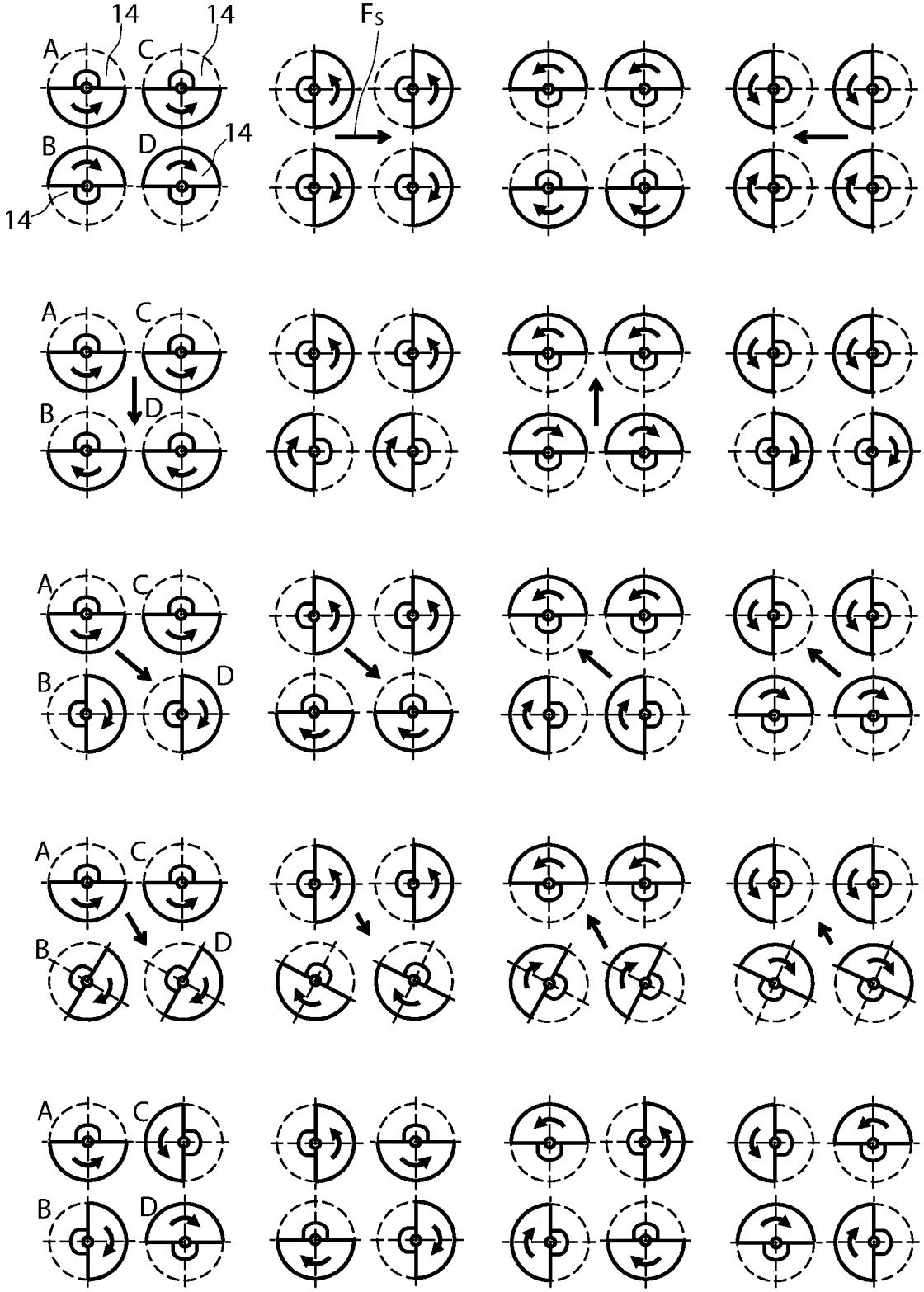

FIG. 16 shows five different impact force settings for four imbalance masses A, B, C, D with the respectively resulting impact force $F_S$. From the left to the right, four positions of the respective impact force setting are shown, i.e. at the phase angles $\phi$ being 0°, 90°, 180° and 270°. By way of a changed specification of the first phase shift $\Delta\varphi_1$ and the second phase shift $\Delta\varphi_2$ by means of the common control device 31, the required impact force $F_S$ is set quickly and precisely. In this, the control device 31 comprises a computing unit to set the optimal impact force $F_S$ in dependence on a local track condition. For this optimizing procedure, corresponding control signals from sensors arranged on the machine 1 or track data determined beforehand are supplied to the control device 31.

The invention claimed is:

1. A machine for stabilizing a track, comprising:

a machine frame:

on-track undercarriages;

a vertically adjustable stabilizing unit having unit rollers wherein the machine frame is supported on said on-track undercarriages and said vertically adjustable stabilizing unit designed to roll on rails of the track by means of said unit rollers;

wherein the stabilizing unit comprises:

a vibration exciter with rotating imbalance masses for generating an impact force ($F_S$) acting dynamically in a track plane perpendicularly to a track longitudinal direction and a vertical drive for generating a vertical load acting on the track, wherein the vibration exciter comprises:

at least two imbalance masses forming an imbalance pair comprising a left-turning imbalance mass and a right-turning imbalance mass and wherein at least one imbalance mass of said imbalance mass pair is driven applying a first phase shift ($\Delta\varphi_1$) which is variably adjustable with respect to an initial position which are driven applying a variably adjustable phase shift ($\Delta\varphi_1$, $\Delta\varphi_2$);

wherein the vibration exciter comprises at least four rotatable imbalance masses, of which two imbalance masses-in each case are driven right-turning and two imbalance masses are driven left-turning; and wherein the two left-turning imbalance masses are driven with a variably adjustable second phase shift ($\Delta\varphi_2$) to one another, and wherein the two right-turning imbalance masses are driven with a variably adjustable second phase shift ($\Delta\varphi_2$) to one another.

2. The machine according to claim 1, wherein an angle sensor is associated with each imbalance mass.

3. The machine according to claim 1, wherein the respective imbalance mass is arranged on the stabilizing unit with a rotation axis being aligned in the track longitudinal direction.

4. The machine according to claim 1, wherein a separate drive is associated with each imbalance mass.

5. The machine according to claim 4, wherein the respective drive is designed as an electric drive.

6. The machine according to claim 5, wherein the electric drives are controlled by means of a common control device.

7. The machine according to claim 4, wherein the respective drive is designed as a hydraulic drive.

8. The machine according to claim 4, wherein an adjustment device for a variable phase shift ($\Delta\varphi_1$, $\Delta\varphi_2$) is associated with the respective drive.

9. The machine according to claim 1, wherein a common drive is associated with two imbalance masses.

10. A method of operating a machine according to claim 1, comprising the steps of:

setting the stabilizing unit down on the track via the vertical drive and actuated with a vertical load, and driving said at least two rotatable imbalance masses by applying a variably adjustable second phase shift ($\Delta\varphi_1$, $\Delta\varphi_2$) to one another;

wherein one imbalance mass in an imbalance pair is driven right-turning and one imbalance mass is driven left-turning, and wherein at least one of these imbalance masses is driven applying a first phase shift ($\Delta\varphi_1$) which is variably adjustable with respect to an initial position;

wherein in the case of four imbalance masses, two left-turning imbalance masses are driven applying a variably adjustable second phase shift ($\Delta\varphi_2$) to one another and two right-turning imbalance masses are driven applying a variably adjustable second phase shift ($\Delta\varphi_2$) to one another.

* * * * *